United States Patent [19]

Fick

[11] 4,059,860

[45] Nov. 29, 1977

[54] APPARATUS FOR MAKING SHOULDERED TUBULAR RIVETS

[75] Inventor: Paul A. Fick, Fremont, Ohio

[73] Assignee: The National Machinery Company, Tiffin, Ohio

[21] Appl. No.: 695,089

[22] Filed: June 11, 1976

Related U.S. Application Data

[62] Division of Ser. No. 519,925, Nov. 1, 1974, Pat. No. 3,978,538.

[51] Int. Cl.[2] ..... B21K 1/60

[52] U.S. Cl. ..... 10/11 R

[58] Field of Search ..... 10/10 R, 11 R, 11 E, 10/24, 27 R, 27 E, 27 PH; 85/37

[56] References Cited

U.S. PATENT DOCUMENTS

| | | | |
|---|---|---|---|
| 1,832,167 | 11/1931 | Wilcox | 10/27 E |
| 2,027,980 | 1/1936 | Horton | 10/27 E |
| 2,395,721 | 2/1946 | Buchet | 10/11 R |
| 2,426,422 | 8/1947 | Torresen | 10/27 E |
| 2,565,665 | 8/1951 | Reich | 10/27 R |
| 2,586,336 | 2/1952 | Huck | 10/27 PH |
| 2,813,279 | 11/1957 | Friedman | 10/27 PH |
| 3,072,933 | 1/1963 | Carlson | 10/27 E |
| 3,088,140 | 5/1963 | Carlson | 10/27 PH |
| 3,169,256 | 2/1965 | Siebol et al. | 10/27 PH |
| 3,200,424 | 8/1965 | McClellan et al. | 10/27 PH |
| 3,540,255 | 11/1970 | Hanna | 10/27 E |
| 3,555,874 | 1/1971 | Kuhn | 10/27 E |

*Primary Examiner*—E. M. Combs

*Attorney, Agent, or Firm*—McNenny, Pearne, Gordon, Gail, Dickinson & Schiller

[57] ABSTRACT

A method and apparatus for forming shouldered tubular rivets is disclosed in which three forming operations are provided, two of which are performed in a single die station. In the first operation, the head end of the blank is squared and the inner end is trapped extruded. In the second operation, both the shoulder and the inner end of the blank are squared. During such second operation, the volume required to form the entire shank is confined within the die and the projecting portion of the blank is headed so that variations in blank volume appear as variations in the head. In the last or third operation, the tubular section is extruded on the inner end of the blank. An apparatus for performing the method is disclosed which permits the accurate positioning of a sleeve and an extrusion pin with respect to the die during the second operation to insure proper squaring of the inner end of the blank and the confinement of the exact volume of material required to form the entire shank of the rivet.

3 Claims, 8 Drawing Figures

APPARATUS FOR MAKING SHOULDERED TUBULAR RIVETS

This is a division of application Ser. No. 519,925, filed Nov. 1, 1974, now U.S. Pat. No. 3,978,539.

BACKGROUND OF THE INVENTION

This invention relates generally to tubular rivets and more particularly to a novel and improved method and apparatus for accurately forming tubular rivets such as, for example, shouldered tubular rivets.

PRIOR ART

Generally tubular rivets have been formed by progressively cold forming in two or more forging operations. In some instances, the head and tubular skirt has been formed simultaneously. In other instances rivets have been formed by extruding all or part of the tubular portion over a punch and subsequently upsetting a finished head on the other end of the blank. In still other instances, it has been proposed to head a blank and thereafter form a tubular skirt. Difficulty has often been encountered in accurately maintaining the desired dimensions of the shank and of the tubular section of the rivet. Such difficulty has resulted from variations in the volume of the blank being formed, resulting from inconsistent wire size and variation in the blank shearing operations. Difficulties also result from inconsistencies in the performance of the forming operations.

Examples of prior art, methods and apparatus are illustrated in the U.S. Pat. Nos. 1,730,954; 1,830,722; 2,396,995; 2,586,336 and 3,200,424.

SUMMARY OF THE INVENTION

The present invention has several important aspects. In accordance with one aspect of the present invention, a rivet is progressively formed in such a way that the desired dimensions of the shank and tubular portion of the rivet are very accurately maintained. The operations are arranged to insure consistency and are further arranged to insure that any variation in the volume of the blank being formed appears in the head of the rivet where such variation does not provide any significant problem. In accordance with another aspect of this invention, a novel and improved method and apparatus is provided for accurately and consistently forming shouldered tubular rivets or the like.

In the illustrated embodiment, the rivet is formed in three progressive, cold working operations with the second and third operation being performed in a single die station.

In the first operation, the blank is trapped extruded to produce an extruded section of reduced diameter at the inner end of the blank, joined to the unextruded portion of the blank by a rounded shoulder. In such first operation, the unextruded portion of the blank is accurately sized and the outer end of the blank, remote from the extruded portion, is squared. However, the length of the extruded portion varies with the volume of the blank.

In the second operation, the blank is positioned within a die assembly providing a substantially square inner end wall and providing a die cavity having a volume equal to the volume required to accurately complete the entire shank portion of the rivet including the tubular skirt portion thereof. Such die assembly is also provided with a relatively sharp shoulder. During the second operation, the blank is pressed into the die and the inner end thereof is squared against the end wall of the die assembly. Also, the shoulder is sheared back to square-up the shoulder and to fill it with greater definition. During the final portion of the second operation, the material of the blank projecting from the die cavity is upset to the finished head form. Because the amount of blank material contained within the die cavity is accurately maintained by completely filling the die cavity, any variations in blank size created either by variations in the cut-off operation of the blank from the stock, or by variations in the blank diameter, is compensated for and such variations appear in the head rather than in the portion of the blank which will ultimately form the shank and the tubular skirt.

On the third operation, which in the illustrated embodiment occurs in the same die as the second operation, the extruded portion from the first operation is extruded to form the tubular section. The extrusion pin is moved forward to position it for extrusion of the tubular skirt between the second and third operations. In the third operation, the confining die moves with the blank during the extruding operation to assist in the flow of the material over the extrusion pin.

In accordance with still another aspect of this invention, a novel and improved apparatus is provided which allows the precise positioning of the punch and its surrounding sleeve permitting them to cooperate and provide a substantially square end wall at the inner end of the die cavity during the second operation and which further allows the precise positioning of the punch for the proper extrusion in the last operation.

DETAILED DESCRIPTION OF THE DRAWINGS

Figure 1:
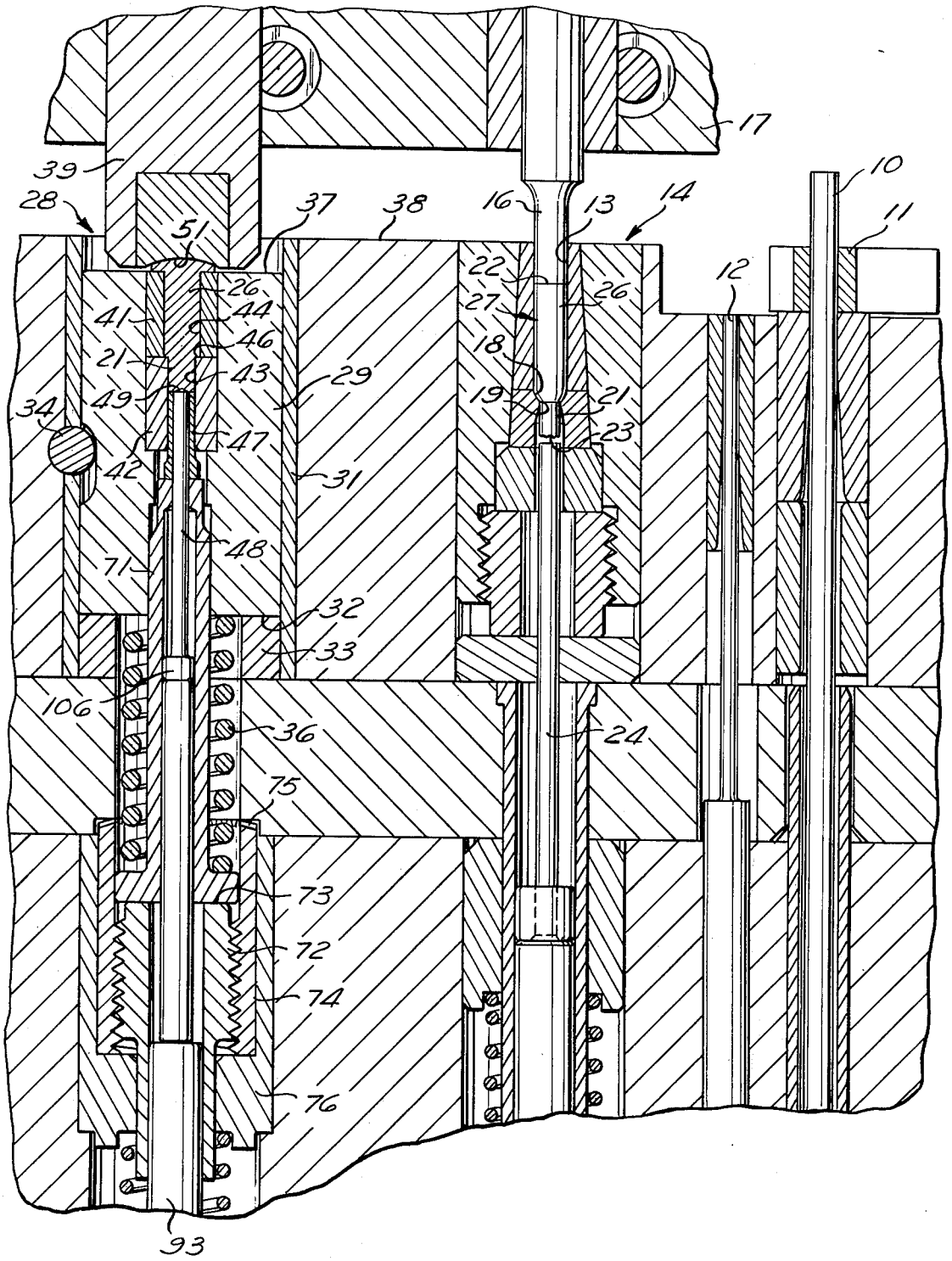
FIG. 1 is a fragmentary cross-section illustrating the shear station and the two die stations and showing the tool carrying slide in its forward dead center position at the completion of the first and second operations on the blanks.
Figure 8:
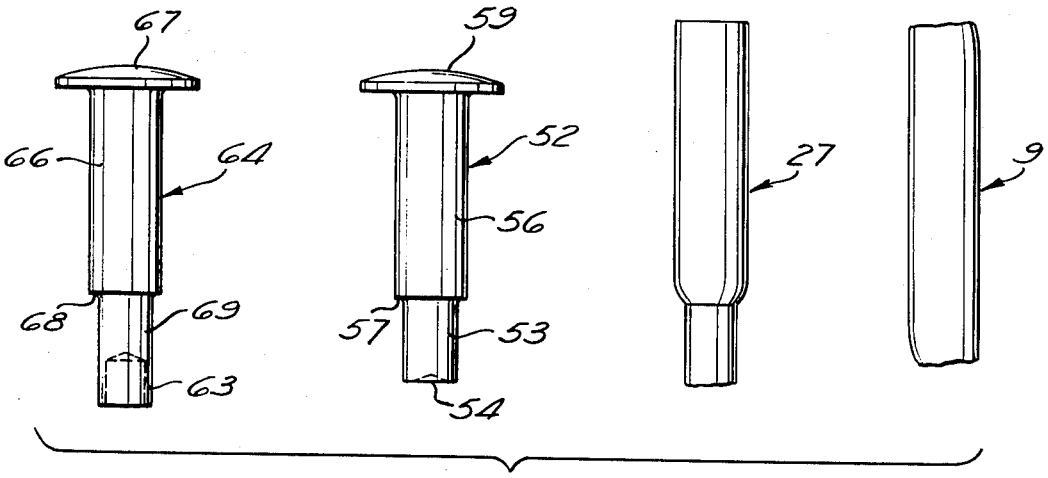
FIG. 8 is a progression illustrating the initial blank as sheared and the shape of the blank at the completion of each of the three operations performed thereon.

FIG. 1 illustrates the shear station with wire stock 10 fed through a shear ring 11 which operates to cut a blank 9 (best illustrated in FIG. 8) from the stock and to carry it over to a position in front of a pin 12. The pin operates to eject the blank from the shear ring 11 into transfer fingers (not illustrated). The transfer fingers position the blank 9 in alignment with the die cavity 13 at a first die station 14. A tool 16, carried by reciprocating slide 17, engages the blank 9 carried by transfer fingers and moves it into the die to the position illustrated in FIG. 1.

The die cavity 13 is provided with a rounded shoulder 18 extending inwardly to an extrusion throat 19, having a diameter smaller than the diameter of the blank being formed. The length of the die cavity outwardly of the shoulder 18 is proportioned so that the blank is totally confined by the die cavity 13 and the punch 16 before extrusion of the inner end of the blank occurs. As the punch 16 presses the blank into the die cavity with its inner end against the extrusion throat, the diameter of the blank is increased to fill the die cavity and the inner end of the blank is trapped extruded to form an extruded portion 21 at its inner end. The force required to produce this extrusion also results in the squaring of the outer end 22 of the blank.

At the completion of the first operation as illustrated in FIG. 1, the inner end 23 of the blank still remains rough and it does not engage the adjacent end of the knock out pin 24. Any variation existing in the volume of the blank appears in variations in the length of the extrusion portion 21 since the diameter of the main portion 26 is determined by the diameter of the cavity 13 and its length is determined by the spacing between the extrusion throat 19 and the end face of the punch 16. In practice, the diameter of the die cavity 13 is selected to be slightly larger than the diameter of the wire being supplied so that the blank will be increased in its diameter during the forming operation on the first die station 14, the exact diameter of the die cavity.

After the tool 16 is withdrawn by the retraction of the slide, the ejection pin 24 is moved forwardly to eject the first intermediate blank 27 from the first die station die cavity 13. The blank is then transferred by transfer fingers (not illustrated) to a position in front of the second die station 28. The dies at the section die station 28 include a die support ring 29 which is slidable in a sleeve bearing 31 between an extended position determined by a key 34 and a retracted or inner position (illustrated in FIG. 1), in which its inner end 32 engages a spacer ring 33. A spring 36 functions to bias the ring 29 toward the extended position in which its outer face 37 is substantially flush with the face of the die breast 38. Mounted in the ring 29 is an outer tubular die sleeve 41 having a diameter proportioned to receive the main portion 26 of the first intermediate blank 27 with slight clearance. Positioned against the inner end of the die 41 is a second tubular die 42 having a bore 43 proportioned to receive the extruded portion 21 with relatively close clearance. The end face of the die 42 projects inwardly from the bore 44 and the die 41 to provide a square shoulder 46.

Projecting into the inner end of the bore 43 of the die 42 is a tubular sleeve 47 and an extrusion pin 48. During the second operation on the blank, which is the first operation to occur in the second die station 28, the end of the sleeve is positioned in alignment with the end of the pin 48 to provide a substantially square end wall 49 defining the inner end of the die cavity. It is recognized that a shallow conical shape is formed on the end of the extrusion pin 48 and that the end wall 49 is not mathematically square for this reason. However, the end wall is substantially square with respect to the die and serves to smooth and square the inner end of the blank during the second operation thereon. The tool 39 is formed with an insert having a radius head forming cavity 51 which cooperates with the end of the die 41, to form the head of the blank.

During the initial portion of forward movement of the punch, the first intermediate blank 27 is pressed into the die at the second die station 28 while the support ring 29 remains in its extended position substantially flush with the face of the die breast 38. As soon as the rounded shoulder of the blank engages the shoulder 46, initial working occurs to sharpen the shoulder formed on the blank and provides better definition thereon. The action occurring is substantially a cutting back operation which can commence slightly as the die is moved back by the engagement of the blank with the shoulder 46 until the die reaches its inner extreme position against the ring 33 as illustrated. Since engagement occurs before the inner face 23 of the extruded portion 21 engages the square end wall 49.

Since the die is bottomed out, continued movement of the tool causes the cutting back operation to continue until the inner end 23 of the first intermediate blank is in tight and full engagement with the end wall 49. Consequently, the inner end of the blank is precisely squared so that the volume of the extruded portion between the shoulder and the squared end wall 49 is the precise volume required to form the portion of the rivet ahead of the shoulder including the tubular section. The spring is sized so that the member 29 bottoms out and the die cavity is filled before a substantial upsetting occurs.

The sleeve 47 and the pin 48 are accurately positioned to provided this exact volume required in the finished part. Further, the length of the die 41 is accurately manufactured to provide the exact length of the shank portion between the shoulder and the head required by the specification of the rivet.

The size of the die cavity, determined by the dies 41 and 42 in cooperation with the sleeve 47 and pin 48, provides the exact volume required to form the shank of the rivet including the tubular section. Since the die cavity is completely filled, any variation in the volume of the blank occurs in the portion of the blank projecting beyond the end face 37 of the die 41. Also, the diameter of the shank portion is determined by the diameter of the die cavity so variations in the diameter of the stock are eliminated as the die cavity is fully filled. Since the variations in the volume of the blank appear in the variations in the portion of the blank projecting beyond the face of the die 41, and since such portion is the portion of the blank which ultimately becomes the head as the tool 39 continues to move to its forward dead center position, (illustrated in FIG. 1) the variations in volume of the blank occur in the head where such variations are best accommodated.

The second intermediate blank 52 (best illustrated in FIG. 8), includes an extruded end portion 53 having a squared and filled end wall 54. It is recognized again, that this end wall does contain a shallow conical shape. The main shank portion 56 is joined to the extruded portion by a relatively sharp shoulder 57, and the head 59 is formed at the outer end. The length of the shank portions 53 and 56, their diameters and resulting volumes, are consistently and accurately established. All variations in the volume of the blank resulting from variations of the diameter of the stock and variations in shearing appear as variations in the size of the head. However, relatively large variations do not materially change the head diameter so this does not produce a problem.

As the tool 39 is retracted by the slide 17, the spring 36 moves the support ring 29 to its outer position, determined by the position of the key 34. This is the position of the support ring and in turn, the two die elements 41 and 42, illustrated in FIG. 2. During the period in which the slide is spaced back from the die breast, the extrusion pin 48 is moved forward and is positioned for the extrusion, which occurs during the second operation within the second die station 28. The mechanism for moving the extrusion pin 49 forward and for locking the pin is such forward position, is described in detail below.

Figures 2, 3, 4:
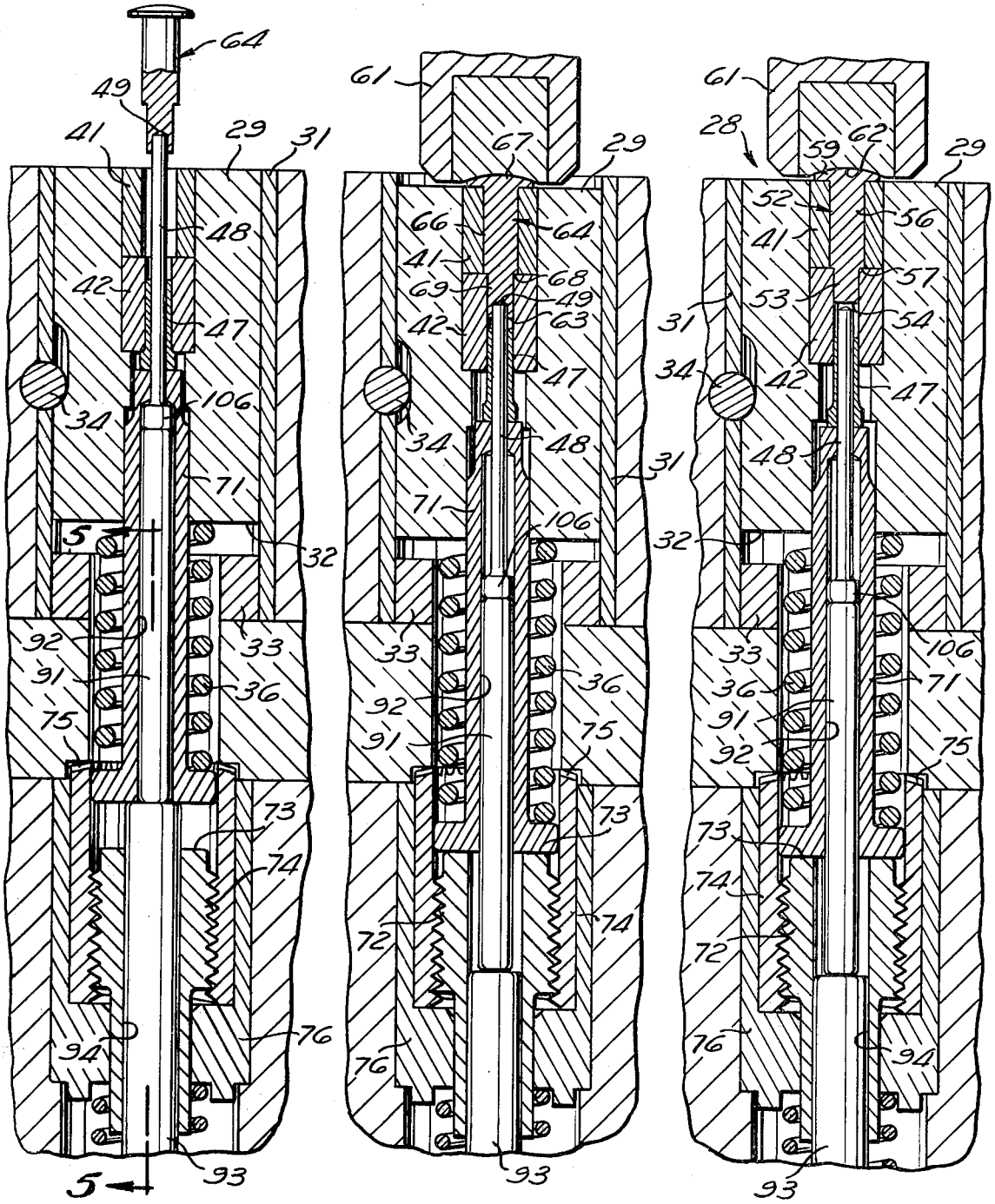
FIG. 2 is a fragmentary section of the second die station illustrating the beginning of the third operation at the moment this tool engages the previously formed head.
FIG. 3 is a fragmentary section similar to FIG. 2 illustrating the tool in its forward dead center position which occurs at the completion of the third operation.
FIG. 4 is a fragmentary section illustrating the ejection of the finished blank from the second die.

While the slide 17 is in the retracted position, the tool 39 is moved clear of the die stations and a different tool 61 is positioned in alignment with the die station. FIG. 2 illustrates the position of the elements at the moment the head cavity 62, formed in the tool 61, engages the head 59 of the second intermediate blank and before working is commenced. In this condition, the end face 54 is spaced from both the end of the extrusion pin 48 and the end of the sleeve 47. However, the under side of the head is in engagement with the end face of the die 41. Therefore, forward movements of the tool 61 beyond the position of FIG. 2 acts through the head of the blank 59 to cause the support sleeve 29 and the two dies 41 and 42 to move inwardly with the tool until the end of the extruded portion 53 engages the end of the extrusion pin 48 to commence extrusion of the tubular skirt on the inner end of the blank.

The forward movement of the tool 61 continues until the position illustrated in FIG. 3 is reached. At this time, the extrusion of the inner end of the blank over the extrusion pin 48 is completed and the inner end of the extruded portion 63 is spaced slightly from the sleeve. This completes the manufacture of the finished rivet 64, best illustrated in FIG. 8. The finished rivet includes a main shank portion 66, extending from the finished head 67 to a shoulder 68. A reduced diameter, or extruded portion 69, extends from the shoulder 68 and includes a tubular extruded portion 63. During the last operation in which the extruded tubular part 63 is formed, the volume and shape of the head 69 is not changed, nor is the diameter and length of the main shank portion 66. Further, the should 68 is not reworked. The only change occuring during the last operation is the extrusion of the tubular skirt 63 from the inner end of the extruded portion 53 of the second intermediate blank.

Because the volume of the extruded portion 53 of the second intermediate blank is precisely controlled, the length of the tubular skirt 63 is also precisely maintained. Consequently, the final rivet 64 has shank portions 66 and 69 which are accurately sized and shaped to meet the most stringent specification requirements as to diameter, length and finish. As mentioned previously, any variations in blank volume occurring either due to variations in the diameter of the stock being supplied, or the shearing of the blanks from the stock, appears as variations in the head where they do not create any problem. Further, since the head is formed at the end of the blank, which is properly squared during the first operation in the die station 14, a uniform, properly filled and properly shaped head is obtained.

As the tool 61 is carried back from the face of the die breast, the extrusion pin 48 is moved further forward to the position of FIG. 4 to eject the finished rivet from the dies 41 and 42. A stripper (not illustrated) is then moved into position to strip the rivet from the end of the pin 48 as it is retracted back into the die.

Figure 6:
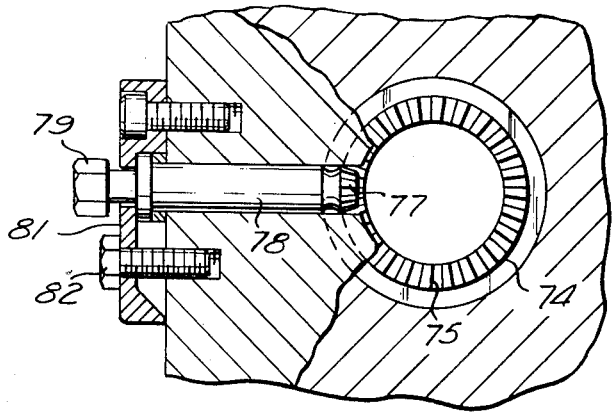
FIG. 6 is a fragmentary section taken generally along 6—6 of FIG. 5.
Figure 5:
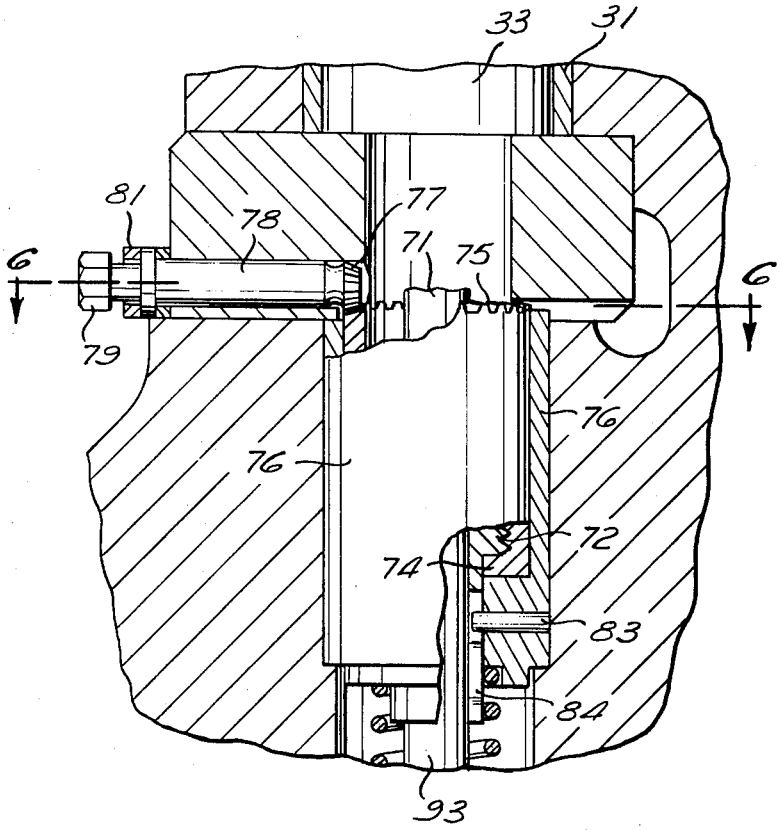
FIG. 5 is a fragmentary section taken generally along 5—5 of FIG. 4.

In the preferred apparatus illustrated, separate means are provided to accurately position are extrusion pin 48 and the sleeve 47 to insure their proper position relative to each other and relative to the die face. Referring to FIGS. 2, 5 and 6, the inner end of the sleeve 47 is seated against the outer end of a locating sleeve 71. The position of the locating sleeve 71 is determined by an externally threaded tube 72, the forward end 73 of which is seated against the rearward end of the locating sleeve 71. The spring 36 normally maintains the rearward end of the locating sleeve 71 against the end face 73.

The adjusting tube 72 is threaded into a tube nut 74 which is positioned in a bearing support ring 76 for adjusting rotation. Referring to FIGS. 5 and 6, the outer ends of the tube nut 74 is formed with bevelled gear teeth 75, which mesh with the teeth 77 of an adjusting pinion 78. An external hex head 79 is provided on the pinion 78 to permit its rotation by a typical wrench. A locking plate 81 releasably locks the pinion 78 in the adjusted position. When locking is desired, a lock screw 82 is tightened and when adjustment is desired by rotation of the pinion 78, the lock screw 82 is loosened.

Rotation of the pinion 78 through the gear connection causes rotation of the tube nut 74 within the support tube 76 to cause relative axial movement of the tube 72. Rotation of the tube 72 with the tube nut 74 is prevented by a pin 83 which extends into an axial slot 84 in the tube 72. With this structure, it is easy to adjust the position of the tube 72 and in turn, the position of the forward end of the sleeve 47 from an external point on the machine. Once the exact adjusted position desired is obtained, the system is locked by tightening the screw 82.

Figure 7:
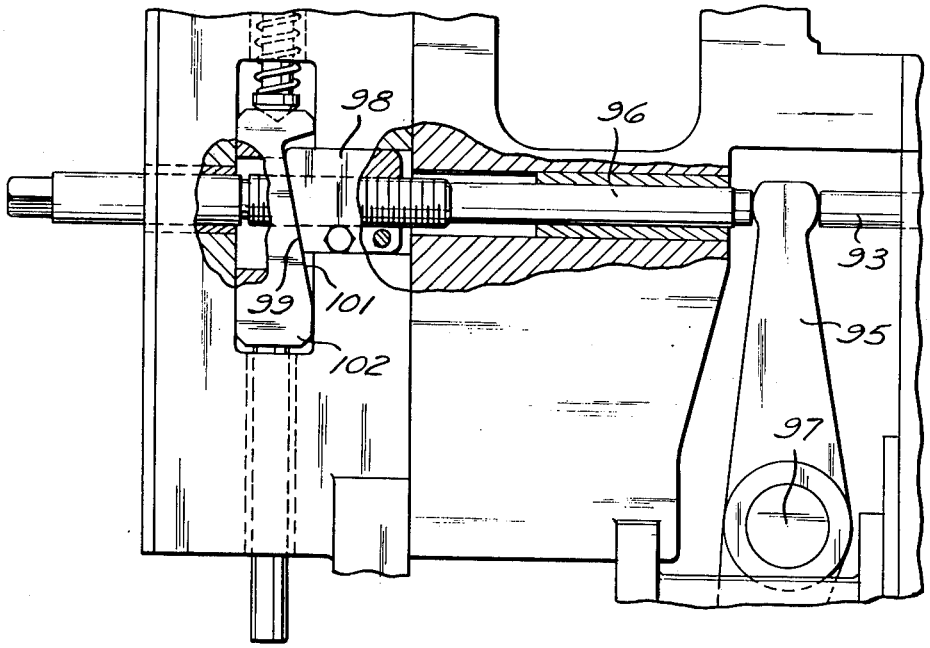
FIG. 7 is a fragmentary section illustrating the mechanism for positioning the punch during the second and third operations and the mechanism for ejecting the blank by moving the punch forward clear of the dies as illustrated in FIG. 4.

The mechanism illustrated in FIG. 7 provides for the positioning and movement of the extrusion pin 48. Referring to FIGS. 1 through 4 and 7, the rearward end of the extrusion pin 48 is seated against an extension pin 91 which is slidably guided by a bore 92 in the locating sleeve 71. The inner end of the pin 91 engages the end of a second pin 93, slidably guided in a bore 94 formed in the adjusting tube 72. Referring to FIG. 7, the rearward end of the pin 93 abuts one side of an ejection lever 95. The other side of the ejection lever 95 is engaged by a locating pin 96, which is coaxial with the pin 93. During all phases of the machine operation other than the ejection, illustrated in FIG. 4, the lever 95 is maintained in contact with the pin 96. However, when ejection is required, the lever 95 is rotated about its pivot 97 in a clockwise direction to move the pins 91, 93 and 48, to the position of FIG. 4 for ejection of the finished rivet.

Threaded to the pin 96 is a cam block 98 having an inclined rearward face 99, engaging an inclined surface 101 on a laterally movable slide cam 102. The rearward end of the pin 96 is provided with a wrenching section to permit its adjustment. Rotation of the pin 96 provides adjustment of the position of the pin 96 with respect to the cam block 98, which is in the illustrated position during the first operation of the second die station. This adjustment provides for the precise positioning of the forward end of the extrusion pin 48 with respect to the forward end of the sleeve 47 during the first operation in the second die station. The forward movement of the extrusion pin 48 from the position of FIG. 1 to the position of FIG. 2, is accomplished by moving the slide cam 102 upward as illustrated in FIG. 7, to cause the pin 96 and in turn the pins 93 and 91, to extend the extrusion pin 48 to the position maintained during the second operation, as illustrated in FIGS. 2 and 3. During such movement, the lever 95 rotates in a clockwise direction under the influence of the movement of the pin 96.

At the completion of the second forming operation in the second die station, the lever 95 is rotated in a clockwise direction to cause ejection of the finished rivet. The drive for controlling the movement of the slide cam 102 and of the lever 95 is not illustrated. Such drive, of course, is timed with the operation of the slide of the machine.

It should be recognized that the sleeve 47 may move forward away from its locating sleeve 71 as the support sleeve 29 is carried back to its forward position after the completion of the first operation. However, even if this occurs, it will be pushed in by the inner end of the blank until it bottoms out and is in its operative position, illustrated in FIG. 2. However, return of the extrusion pin 48 back into the die from the position of FIG. 4 is accomplished by the spring 36 which retracts the locating sleeve 71. This retraction movement of the pin with the sleeve is accomplished by forming a head 106 on the inner end of the extrusion pin, which engages an inwardly extending shoulder at the forward end of the locating sleeve. Various elements are proportioned so that the pin is pulled in at least to the end face of the die 41 by the action of the spring 36. Here again, it is recognized that the pin 48 would normally not be fully retracted to the position of FIG. 1 when the locating sleeve bottoms out. However, engagement of the pin with the subsequent blank causes the pin to be pushed back until it bottoms out as the blank moves into the die cavity. Once it bottoms out it insures proper squaring of the end of the blank.

In the illustrated form of this invention, it is possible to accurately form a shouldered tubular rivet in a two-station machine in which a single operation is performed in the first station and two forming operations are performed in the second station. However, in accordance with some of the aspects of this invention, the manufacture of such rivet can be performed in a three-station machine, in which one operation is performed at each station.

Although a preferred embodiment of this invention is illustrated, it should be understood that various modifications and rearrangements of parts may be resorted to without departing from the scope of the invention disclosed and claimed herein.

What is claimed is:

1. An apparatus for forming shouldered tubular rivets comprising cooperating first tool and die means operable in a first operation to trap extrude a blank to form an extruded inner end portion of reduced diameter and to square the outer end of the blank, said cooperating first tool and die means being structured to accommodate variations in the volume of the blank at the inner end thereof, cooperating second tool and die means operable in a second operation to square said inner end of said blank and confine a predetermined volume extending from said inner end thereof required to form all but the head of the rivet and to upset a head from the unconfined portion, variations in the volume of said blank appearing as variations in the head of said rivet, and third cooperating tool and die means operable in a third operation to forward extrude a tubular skirt on the inner end of said blank.

2. An apparatus for forming shouldered tubular rivets as set forth in claim 1 wherein said second and third die means include a single elongated die provided with a substantially square inner end wall for supporting and squaring said inner end of said blank during said second operation while the head is formed on the blank, and a punch cooperating with said die to form a tubular section for forming said tubular skirt during said third operation.

3. An apparatus as set forth in claim 2 wherein said second and third die means includes a sleeve and a concentric pin both projecting into said elongated die to provide said inner end wall, and first and second adjusting means are provided for independently adjusting the position of said sleeve and pin respectively to insure that said predetermined volume is confined and to insure that said sleeve and pin are properly aligned during said second operation.

* * * * *

UNITED STATES PATENT AND TRADEMARK OFFICE

CERTIFICATE OF CORRECTION

PATENT NO. : 4,059,860

DATED : November 29, 1977

INVENTOR(S) : Paul A. Fick

It is certified that error appears in the above-identified patent and that said Letters Patent are hereby corrected as shown below:

Column 3, line 38, "section" should read --second--.

Column 4, line 15, "Since" should read --Such--.

Column 5, line 10, "49" should read --48--.

Column 5, line 11, "is" first occurrence should read --in--.

Column 5, line 44, "should" should read --shoulder--.

Column 6, line 2, "are" second occurrence should read --the--.

Signed and Sealed this

*Fourth* Day of *July 1978*

[SEAL]

*Attest:*

RUTH C. MASON
*Attesting Officer*

DONALD W. BANNER
*Commissioner of Patents and Trademarks*